US011339510B2

(12) United States Patent
Podhajny et al.

(10) Patent No.: US 11,339,510 B2
(45) Date of Patent: May 24, 2022

(54) WEAVING EQUIPMENT WITH STRAND MODIFYING UNIT

(71) Applicant: Apple Inc., Cupertino, CA (US)

(72) Inventors: Daniel A. Podhajny, San Jose, CA (US); Kathryn P. Crews, San Francisco, CA (US); Yohji Hamada, Wakayama (JP)

(73) Assignee: Apple Inc., Cupertino, CA (US)

( * ) Notice: Subject to any disclaimer, the term of this patent is extended or adjusted under 35 U.S.C. 154(b) by 174 days.

(21) Appl. No.: 16/240,594

(22) Filed: Jan. 4, 2019

(65) Prior Publication Data

US 2019/0136423 A1 May 9, 2019

Related U.S. Application Data

(62) Division of application No. 14/938,661, filed on Nov. 11, 2015, now Pat. No. 10,174,444.

(60) Provisional application No. 62/083,078, filed on Nov. 21, 2014.

(51) Int. Cl.

| | |
|---|---|
| ***D03D 15/00*** | (2021.01) |
| ***D02H 5/02*** | (2006.01) |
| ***D03J 1/14*** | (2006.01) |

(52) U.S. Cl.

CPC ..... *D03D 15/00* (2013.01); *D02H 5/02* (2013.01); *D03J 1/14* (2013.01)

(58) Field of Classification Search

CPC ..... D03D 15/00

See application file for complete search history.

(56) References Cited

U.S. PATENT DOCUMENTS

| | | | |
|---|---|---|---|
| 1,080,298 | A | 12/1913 | Prein |
| 1,083,462 | A | 1/1914 | Prein |
| 1,095,417 | A | 5/1914 | Prein |
| 1,098,756 | A | 6/1914 | Prein |
| 2,012,306 | A | 8/1935 | Fether |
| 2,081,620 | A | 5/1937 | Fether |
| 2,421,135 | A | 5/1947 | Walter et al. |
| 2,593,320 | A | 4/1952 | Lewis et al. |
| 2,797,711 | A | 7/1957 | Ballard |

(Continued)

FOREIGN PATENT DOCUMENTS

WO 2014064455 A1 1/2014

*Primary Examiner* — Andrew T Piziali

(74) *Attorney, Agent, or Firm* — Treyz Law Group, P.C.; G. Victor Treyz; Kendall P. Woodruff

(57) ABSTRACT

Weaving equipment may include warp strand positioning equipment that positions warp strands and weft strand positioning equipment that inserts weft strands among the warp strands to form fabric. One or more of the warp strands may be selectively modified along its length using a warp strand modification unit. The warp strand modification unit may be interposed between the fabric and a reed, may be interposed between the fabric and the warp strand positioning equipment, may be mounted to the reed, or may be incorporated elsewhere in the weaving equipment. Warp strand modifications may include adding segments of metallic paint coatings or other conductive coatings, adding insulating coatings, applying other liquids to segments of the warp strand, modifying the stretchiness of warp strands, removing material from segments of the warp strand, and attaching electrical components to the warp strand.

19 Claims, 14 Drawing Sheets

(56) References Cited

U.S. PATENT DOCUMENTS

| | | | | |
|---|---|---|---|---|
| 3,414,666 | A | 12/1968 | Doundoulakis et al. | |
| 3,495,255 | A | 2/1970 | George | |
| 5,069,257 | A | 12/1991 | Borisch | |
| 6,852,395 | B2 * | 2/2005 | Dhawan | B01D 39/083 428/196 |
| 7,144,830 | B2 * | 12/2006 | Hill | H05K 1/038 442/205 |
| 7,365,031 | B2 * | 4/2008 | Swallow | D02G 3/38 174/124 R |
| 7,470,483 | B2 | 12/2008 | Yoshida et al. | |
| 8,367,942 | B2 * | 2/2013 | Howell | D03D 15/00 174/261 |
| 8,669,195 | B2 | 3/2014 | Swallow et al. | |
| 9,124,680 | B2 | 9/2015 | Lundell | |
| 2001/0013377 | A1 | 8/2001 | Wahhoud et al. | |
| 2003/0211797 | A1 | 11/2003 | Hill et al. | |
| 2006/0234584 | A1 * | 10/2006 | Valentine | D04B 1/246 442/304 |
| 2006/0258247 | A1 | 11/2006 | Tao et al. | |
| 2008/0202623 | A1 * | 8/2008 | DeAngelis | D06N 3/0063 139/425 R |
| 2009/0272455 | A1 | 11/2009 | Speich | |
| 2011/0073353 | A1 * | 3/2011 | Lee | D03D 15/00 174/254 |
| 2014/0209375 | A1 | 7/2014 | Linow et al. | |
| 2014/0246415 | A1 | 9/2014 | Wittkowski et al. | |
| 2016/0160403 | A1 * | 6/2016 | Van Keymeulen | H01L 23/4985 428/221 |

* cited by examiner

WEAVING EQUIPMENT WITH STRAND MODIFYING UNIT

This application is a division of patent application Ser. No. 14/938,661, filed on Nov. 11, 2015, which claims the benefit of provisional patent application No. 62/083,078, filed on Nov. 21, 2014, both of which are hereby incorporated by reference herein in their entireties.

BACKGROUND

This relates generally to weaving and, more particularly, to equipment for processing strands during weaving.

It may be desirable to form fabric from strands of material that are treated differently at different locations along their lengths. Strands may, for example, be dyed with different colors at different locations. Strands of this type may be woven together to produce fabric with colored patterns.

In warp ikat fabrics, warp threads are printed with specific patterns. It can be challenging to use traditional weaving equipment to form fabrics such as warp ikat fabrics in which the printed patterns are aligned as desired with the underlying structures of a fabric (i.e., the connecting warp and weft threads that determine the fabric's construction and properties). In most looms, there is a relatively long distance between the warp beam and the fabric being woven. As a result, it can be difficult to accurately position warp strands with respect to each other and with respect to the weft strands that are being used to form the fabric. Adjacent warp strands can become misaligned with respect to each other and may not align properly with the weft strands. This can make it impossible to form precise patterns in the fabric. More accurate weaving would allow improved fabric-based items to be formed.

It would therefore be desirable to be able to process strands at various locations along their lengths in a way that facilitates accurate weaving with the processed strands.

SUMMARY

Fabric may be formed by weaving warp strands and weft strands together using weaving equipment. The weaving equipment may include warp strand positioning equipment that positions the warp strands to produce a shed and weft strand positioning equipment that inserts weft strands into the warp strands to form the fabric. Strands may be selectively modified prior to weaving. For example, one or more of the warp strands may be selectively modified along its length using a warp strand modification unit.

A warp strand modification unit may be located adjacent to the edge of the fabric that is being woven. This allows warp strand segments that have been modified to be accurately aligned with desired weft strands. For example, a segment of a warp strand may be positioned to overlap a particular weft strand.

The warp strand modification unit may be interposed between the fabric and a reed, may be interposed between the fabric and the warp strand positioning equipment, may be mounted to the reed, or may be incorporated elsewhere in the weaving equipment.

The warp strand modification unit may add segments of metallic paint coatings or other conductive coatings, may add insulating coatings, may apply liquids to segments of the warp strands such as liquids that modify the stretchiness of warp strands and that remove material from segments of the warp strands, may attach electrical components to the warp strands, and may otherwise selectively modify the warp strands.

DETAILED DESCRIPTION

Figure 1:
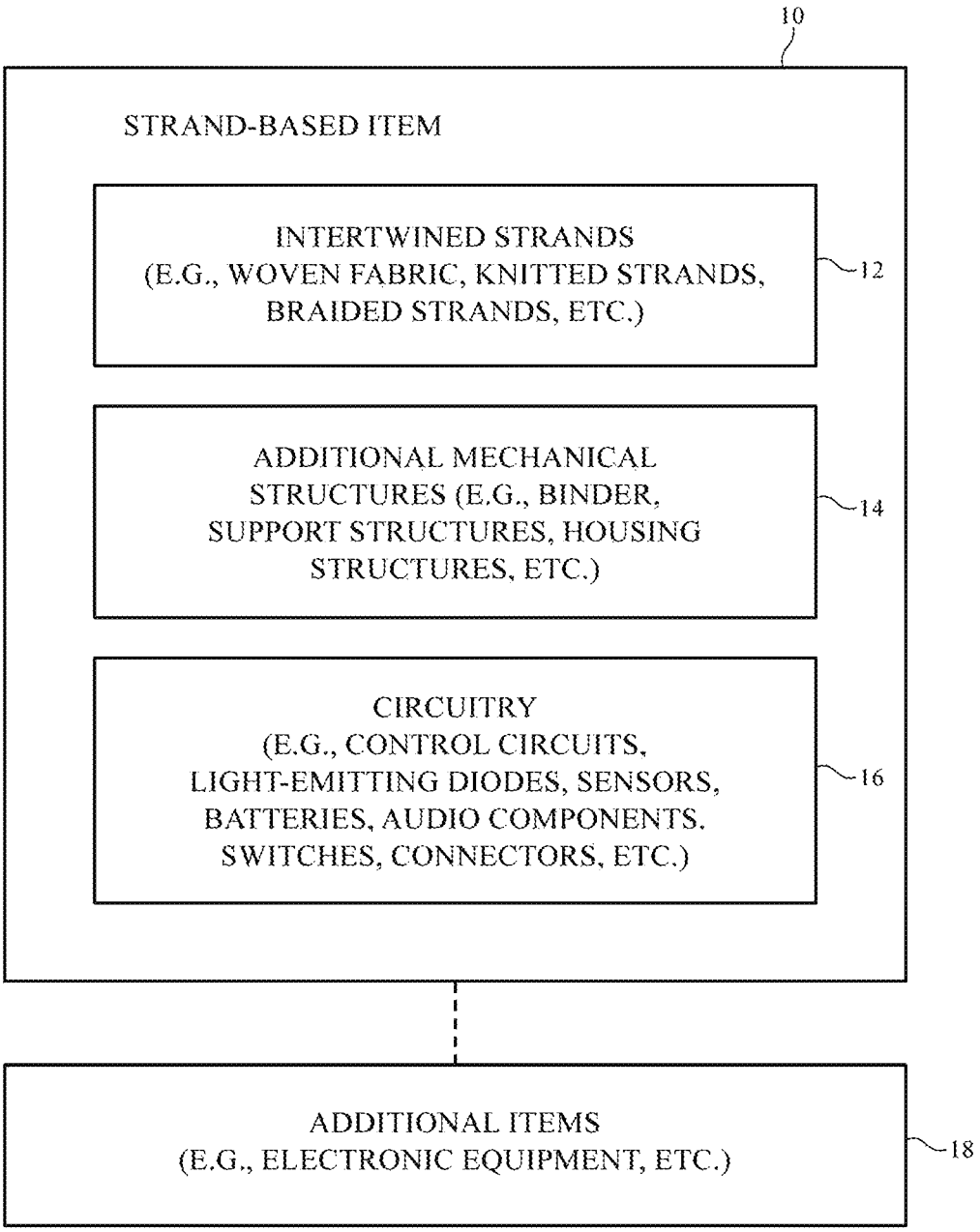
FIG. 1 is a schematic diagram of an illustrative strand-based item in accordance with an embodiment.

Selectively modified strands may be incorporated into strand-based items such as strand-based item of FIG. 1. Item 10 may be an electronic device or an accessory for an electronic device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric-based item 10 is mounted in a kiosk, in an automobile, airplane, or other vehicle, other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, etc.), or may be any other suitable fabric-based item.

Strands in strand-based item 10 may form all or part of a housing wall for an electronic device, may form internal structures in an electronic device, or may form other strand-based structures. Strand-based item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

Item 10 may include intertwined strands 12. The strands may be intertwined using strand intertwining equipment such as weaving equipment, knitting equipment, or braiding equipment. Intertwined strands 12 may, for example, form woven fabric.

Strands 12 may be single-filament strands or may be threads, yarns, or other strands that have been formed by intertwining multiple filaments of material together. Strands may be formed from polymer, metal, glass, graphite, ceramic, natural fibers such as cotton or bamboo, or other organic and/or inorganic materials and combinations of these materials. Conductive coatings such as metal coatings may be formed on non-conductive strands (e.g., plastic cores) to make them conductive. Reflective coatings such as metal coatings may be applied to strands to make them reflective. Strands may also be formed from single-filament metal wire, multifilament wire, or combinations of different materials. Strands may be insulating or conductive. Strands may be conductive along their entire length or may have conductive segments (e.g., metal portions that are exposed by locally removing insulation or that are formed by adding a conductive layer to a portion of a non-conductive strand). Threads and other multifilament yarns that have been formed from intertwined filaments may contain mixtures of conductive fibers and insulating fibers (e.g., metal strands or metal coated strands with or without exterior insulating layers may be used in combination with solid plastic fibers or natural fibers that are insulating).

Item 10 may include additional mechanical structures 14 such as polymer binder to hold strands 12 together, support structures such as frame members, housing structures (e.g., an electronic device housing), and other mechanical structures.

Circuitry 16 may be included in item 10. Circuitry 16 may include components that are coupled to strands 12, components that are housed within an enclosure formed by strands 12, components that are attached to strands 12 using welds, solder joints, adhesive bonds (e.g., conductive adhesive bonds), crimped connections, or other electrical and/or mechanical bonds. Circuitry 16 may include metal structures for carrying current, integrated circuits, discrete electrical components such as resistors, capacitors, and inductors, switches, connectors, light-emitting components such as light-emitting diodes, audio components such as microphones and speakers, vibrators, solenoids, piezoelectric devices, and other electromechanical devices, connectors, microelectromechanical systems (MEMs) devices, pressure sensors, light detectors, proximity sensors, force sensors, moisture sensors, temperature sensors, accelerometers, gyroscopes, compasses, magnetic sensors, touch sensors, and other sensors, components that form displays, touch sensors arrays (e.g., arrays of capacitive touch sensor electrodes to form a touch sensor that detects touch events in two dimensions), and other input-output devices. Circuitry 16 may also include control circuitry such as non-volatile and volatile memory, microprocessors, application-specific integrated circuits, system-on-chip devices, baseband processors, wired and wireless communications circuitry, and other integrated circuits.

Item 10 may interact with electronic equipment or other additional items 18. Items 18 may be attached to item 10 or item 10 and item 18 may be separate items that are configured to operate with each other (e.g., when one item is a case and the other is a device that fits within the case, etc.).

As shown in FIG. 1, circuitry 16 may include antennas and other structures for supporting wireless communications with item 18. Item 18 may also interact with strand-based item 10 using a wired communications link or other connection that allows information to be exchanged.

In some situations, item 18 may be an electronic device such as a cellular telephone, computer, or other portable electronic device and strand-based item 10 may form a case or other structure that receives the electronic device in a pocket, an interior cavity, or other portion of item 10. In other situations, item 18 may be a wrist-watch device or other electronic device and item 10 may be a strap of other strand-based item that is attached to item 18. In still other situations, item 10 may be an electronic device, strands 12 may be used in forming the electronic device, and additional items 18 may include accessories or other devices that interact with item 10.

If desired, magnets and other structures in items 10 and/or 18 may allow items 10 and 18 to interact wirelessly. One item may, for example, include a magnet that produces a magnetic field and the other item may include a magnetic switch or magnetic sensor that responds in the presence of the magnetic field. Items 10 and 18 may also interact with themselves or each other using pressure-sensitive switches, pressure sensors, force sensors, proximity sensors, light-based sensors, interlocking electrical connectors, etc.

The strands that make up item 10 may be intertwined using any suitable strand intertwining equipment. With one suitable arrangement, which may sometimes be described herein as an example, strands 12 may be woven together to form a fabric. The fabric may have a plain weave, a satin weave, a twill weave, or variations of these weaves, may be a three-dimensional woven fabric, or may be other suitable fabric.

Figure 2:
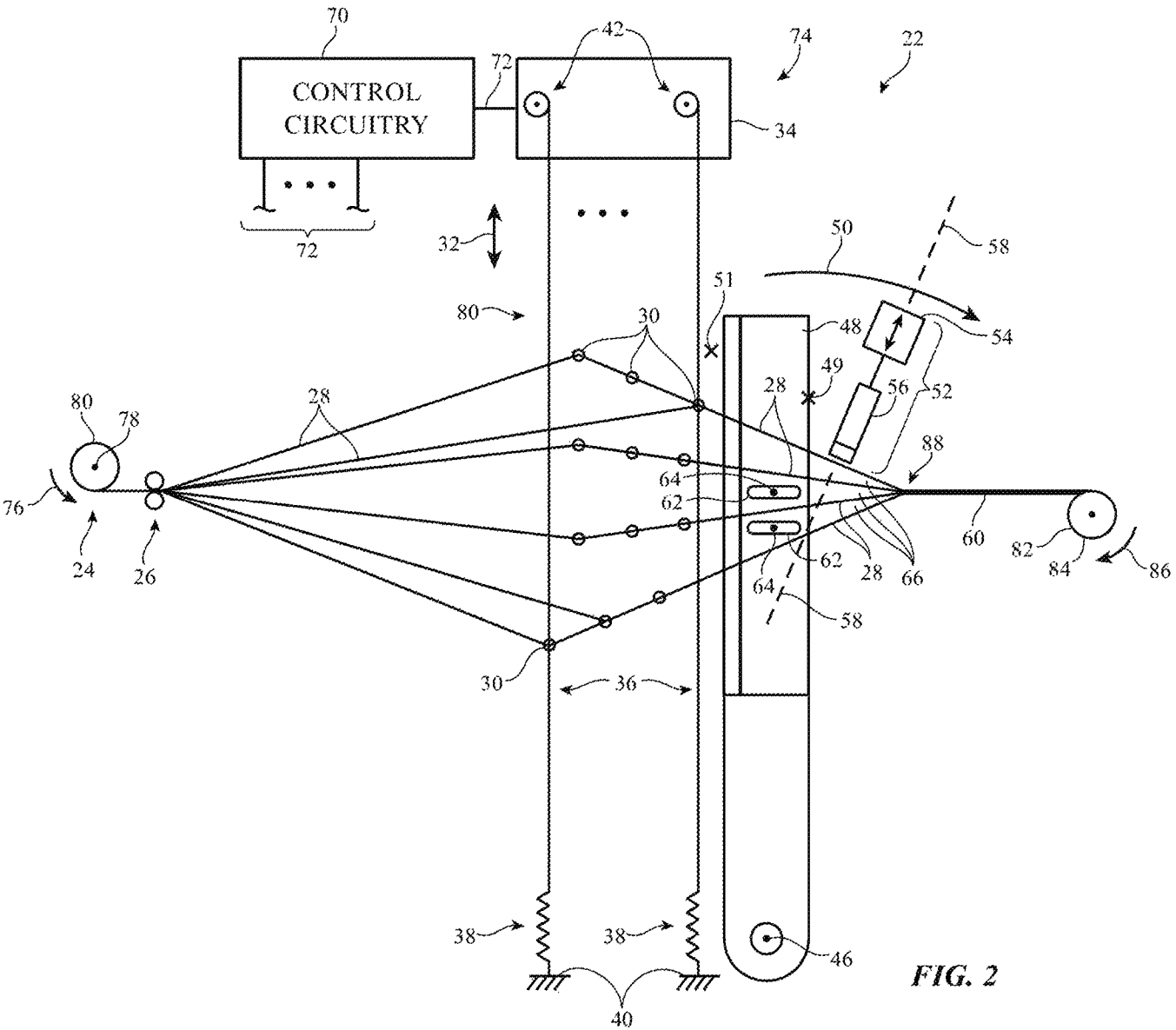
FIG. 2 is a side view of illustrative weaving equipment that may be used to form fabric in accordance with an embodiment.

Illustrative weaving equipment for forming woven fabric for items such as item 10 of FIG. 1 is shown in FIG. 2. As shown in FIG. 2, weaving equipment 22 may be provided with strands such as strands 12 of FIG. 1 from strand source 24. The strands provided by strand source 24 may be single filaments of material or may be threads, yarns, or other multifilament strands that have been formed by intertwining multiple single-filament strands. Strands may be formed from insulating materials, conductive materials, and combinations of insulating and conductive materials.

Source 24 may supply warp strands 28 from warp beam 80. Warp beam 80 may be implemented using a drum or other structure that rotates about rotational axis 78 in direction 76. Warp strands 24 may be dispensed between rollers 26 as the drum rotates.

Warp strands 28 may be positioned using warp strand positioning equipment 74. Equipment 74 may include strand positioning structures such as harness 80. Harness 80 may be controlled using control circuitry 70 to control the positions of strands 28.

As shown in FIG. 2, harness 80 may include heddles 36. Heddles 36 may each include an eye 30 mounted on a wire that extends between a respective one of springs 38 and a respective one of wire positioners 42 or may use other structures for positioning warp strands 28. Wire positioners 42 may be motors (e.g., stepper motors) or other electromechanical actuators. Some or all of heddles 36 may be independently positioned. During operation, control circuitry 70 may supply control signals on outputs 72 that move each heddle by a desired amount (e.g., up or down in directions 32). By raising and lowering the heddles in various patterns in response to control signals from control circuitry 70, different patterns of gaps (sheds) 66 between warp strands 28 may be created.

Weft strand 58 may be inserted into sheds 66 during weaving to form fabric 60. Weft strand positioning equipment 62 may be used to place weft strand 58 between the warp strands forming each shed 66. Weft strand positioning equipment 62 may include one or more shuttles or may include shuttleless weft strand positioning equipment (e.g., needle weft strand positioning equipment, rapier weft strand positioning equipment, or other weft strand positioning equipment such as equipment based on projectiles, air or water jets, etc.).

After each pass of weft strand 64 is made through shed(s) 66, reed 48 may be moved in direction 50 (e.g., reed 48 may be rotated about axis 46) to push the weft strand that has just been inserted into the shed between respective warp strands 28 against previously woven fabric 60, thereby ensuring that a satisfactorily tight weave is produced. Fabric 60 that has been woven in this way may be gathered on take-down roller 82 as roller 82 rotates in direction 86 about rotational axis 84. Reed 48 and weft strand positioning equipment 62 may be controlled by control signals from control outputs 72.

Strand modification equipment such as strand modification unit 52 may be used in processing one or more warp strands 28. As shown in FIG. 2, strand modification unit 52 may have positioning equipment such as computer-controlled positioner 54 and strand processing head 56 (or, if desired, multiple positioners 54 coupled to multiple respective heads 56).

Each positioner 54 and processing head 56 may be controlled by control circuitry 70 using control signals on control outputs 72. The position of head 56 may, for example, be adjusted by positioner 54 to place head 56 in and out of use. As one example, head 56 may contain a liquid-soaked pad. The liquid may be a colored ink or other colorant or may be other liquid. When it is desired to apply the liquid to warp strand 28, positioner 54 may move head 56 into contact with warp strand 28. When it is desired to terminate the liquid application process, positioner 54 may pull head 56 away from warp strand 28. The positions of strands 28 relative to heads such as head 56 may also be controlled using warp strand positioning equipment 74 (whether or not equipment 74 is being used to position strands 28 to form sheds 66 to accommodate weft strand 64).

The application of liquids such as inks to strand 28 is merely an illustrative example of a potential strand modification that may be made using unit 52. Other liquids may also be applied (e.g., metallic paint, material for removing selected portions of strand 28, insulating material such as adhesive, etc.). In general, unit 52 may be used to apply material, remove material, change strand 28 or portions of strand 28 by application of energy, may mechanically alter strand 28, or may otherwise process strand 28.

Strand modification unit 52 may, for example, be used to apply material to strand 28. The applied material may be used to selectively adjust the properties of strands 28. For example, material may be applied to strand 28 that changes the stiffness of strand 28. If strand 28 is relatively flexible and stretchable, the applied material may locally increase the stiffness of strand 28 and thereby reduce flexibility and stretchability. If strand 28 is relatively stiff, the applied material may locally increase the flexibility and/or stretchability of strand 28.

Unit 52 may also be used to apply conductive material (e.g., conductive adhesive, metallic paint, etc.) to strand 28. The conductive material may selectively increase the conductivity of strand 28. If, as an example, strand 28 is formed from a polymer strand or other dielectric strand, use of unit 52 to apply a conductive adhesive or metallic paint to strand 28 to one or more segments of strand 28 can render the one or more segments of strand 28 conductive.

If desired, unit 52 may also be used to apply a solvent such as an etchant or other substance that removes material from strand 28 (e.g., to strip polymer insulation from the outer surface of a metal wire, etc.). With this type of arrangement, strand 28 may have an insulating coating except where strand 28 has been stripped of insulation with the solvent to allow electrical components to be attached to strand 28.

Other techniques may also be used to selectively remove material from strand 28 or to selectively texture or otherwise treat exterior of portions of strand 28. These techniques may involve applying energy (light, heat, electricity, plasma, etc.) to strand 28. The application of energy to strand 28 may locally remove a conductive or insulating exterior coating. For example, a conductive coating on a dielectric strand may be locally removed to form an insulating segment between two conductive segments or an insulating coating on a metal strand may be locally removed to form a strand segment with a conductive surface between two insulated strand portions.

Cutting blades and other mechanical equipment may be used to process strand 28 (e.g., to remove insulation, to remove a conductive coating, to roughen the exterior of strand 28, etc.). The coatings that are applied to strand 28 by unit 52 may include colored materials (e.g., colored inks), may include dyes, pigments, adhesives, polymers, conductive materials, etchants and other solvents for selectively removing dielectric and/or metallic materials from strand 28, etc.

As part of the processing of strand 28 by unit 52, electrical components may be crimped into place on strand 28 or may be electrically and mechanically mounted on strand 28 using other techniques (e.g., soldering, etc.).

Unit 52 may be located adjacent to edge 88 of fabric 60, so that the accuracy with which the processed portion of strand 28 is placed within fabric 60 is enhanced. With this type of arrangement, modifications to warp strand 28 take place just as strand 28 is being incorporated into fabric 60, so that there is a reduced possibility that the selectively modified portions of each strand 28 will shift out of desired alignment with respect to weft strands 64. Accurate placement of the processed warp strand portions relative to weft strands 64 may allow electrical connections to be made for signal paths, may ensure that locally insulated strand segments are properly aligned with other strands, etc.

If desired, unit 52 may be mounted on reed 48 in a location such as illustrative mounting location 49, may be placed between reed 48 and warp strand positioning equipment 74 (e.g., in a location such as illustrative mounting location 51), or may be mounted elsewhere in equipment 22. The configuration of FIG. 2 in which strand modification unit 52 is located between reed 48 and fabric 60 is merely illustrative.

Figure 3:
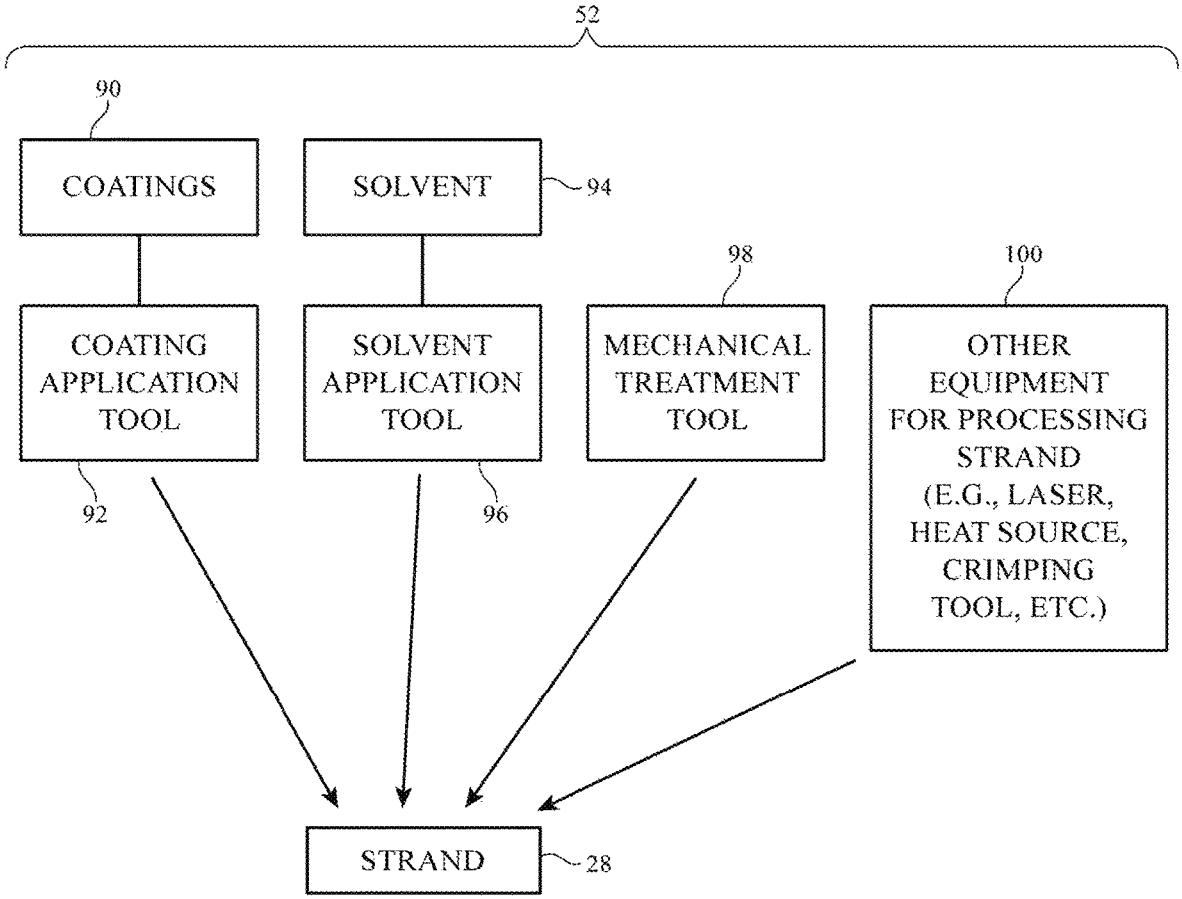
FIG. 3 is a diagram showing how strands may be processed as the strands are being incorporated into a fabric in accordance with an embodiment.

FIG. 3 is a diagram showing different types of equipment that may be included in unit 52 for processing strand 28. As shown in FIG. 3, unit 52 may include coating application tool 92. Coating application tool 92 may be used to apply one or more coatings 90. Coatings 90 may include conductive coatings, dielectric coatings, and other layers of material. Coating application tool 92 may include one or more pads impregnated with liquid coating materials, may include ink-jet coating application equipment, may include equipment for applying liquid coatings using spraying or dipping, or may include other tools for applying coatings 90 to strand 28.

Solvent application tool 96 may be used to apply solvent 94. Solvent 94 may include chemicals that remove dielectric and/or conductive materials from strand 28 (e.g., metal etchant for removing metal, a polymer solvent for dissolving and removing polymer, an etchant for removing inorganic dielectric, etc.). Solvent application tool 96 may include equipment for ink-jet coating, spray coating, pad-based coating, dipping, or other tools for supplying liquid solvent 94 to strand 28.

Unit 52 may include one or more mechanical treatment tools such as tool 98. The mechanical treatment tools may be used to remove coatings, to change the texture of strand 28, or to otherwise process strand 28. Tool 98 may include equipment for cutting strand 28, for scoring strand 28, for roughening the surface of strand 28, for bending strand 28, or for otherwise mechanically processing strand 28.

If desired, other equipment 100 may be used in processing strand 28. Equipment 100 may include a heat source (e.g., a flame, a heated metal structure or other heated structure, a lamp that produces heat, etc.). Equipment 100 may also include a laser, light-emitting diode, or other light source (e.g., an infrared laser or infrared light-emitting diode, a visible laser or visible light-emitting diode, and/or an ultraviolet laser or light-emitting diode). By applying heat or light or other energy to strand 28, coatings can be selectively removed, liquid polymers and other coating materials may be cured, the texture of strand 28 may be altered, or other strand modifications can be made.

Equipment 100 may be used in attaching electrical components such as electrical components in circuitry 16 of FIG. 1 to strand 28. For example, equipment 100 of unit 52 may be used to attach electrical components to strand 28 using solder joints, crimped metal connections, welds, conductive adhesive, or other conductive attachment structures. The electrical components that are attached to strand 28 in this way may include light-emitting components, integrated circuits, light-emitting diodes, light-emitting diodes that are packaged with transistor-based circuitry such as communications circuitry and/or light-emitting diode driver circuitry that allows each component to operate as a pixel in a display, discrete components such as resistors, capacitors, and inductors, audio components such as microphones and/or speakers, sensors such as touch sensors (with or without co-located touch sensor processing circuitry), accelerometers, temperature sensors, force sensors, microelectromechanical systems (MEMS) devices, transducers, solenoids, electromagnets, pressure sensors, light-sensors, proximity sensors, buttons, switches, two-terminal devices, three-terminal devices, devices with four or more contacts, etc. Electrical connections for attaching electrical components to strand 28 using equipment 100 may be formed using solder, conductive adhesive, welds, molded package parts, mechanical fasteners, wrapped strand connections, press-fit connections, crimped connections (e.g., bend metal prong connections), and other mechanical connections, portions of liquid coatings (e.g., metallic paint, conductive adhesive, etc.) that are selectively applied to strand 28 using unit 52, or using any other suitable arrangement for forming an electrical short between conductive structures.

Figure 4:
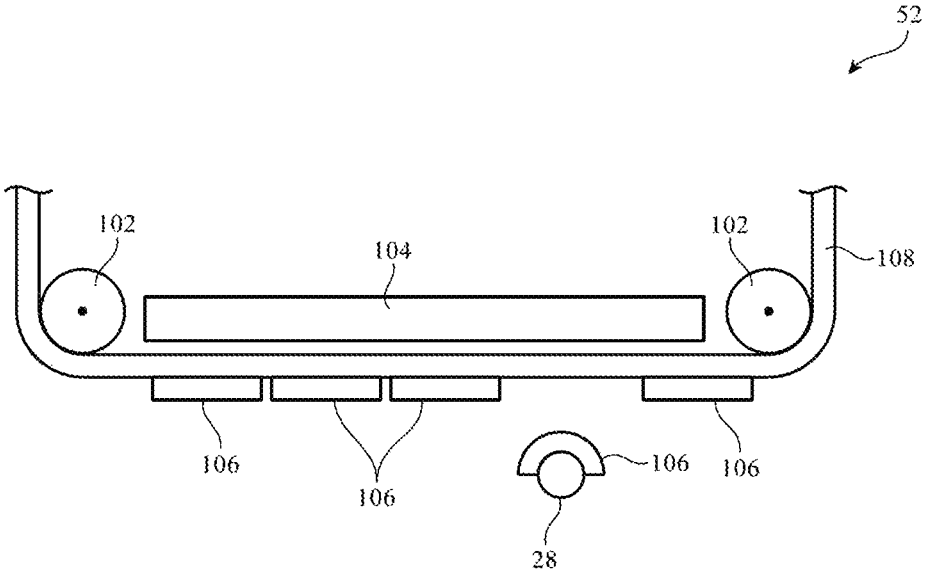
FIG. 4 is a cross-sectional diagram of illustrative equipment for selectively applying adhesive or other materials to a strand as the strand is being woven with other strands to form a fabric in accordance with an embodiment.

FIG. 4 is an end view of a unit 52 in an illustrative embodiment where unit 52 is dispensing patches of adhesive to strand 28. Adhesive 106 may be conductive adhesive to help form conductive joints between overlapping warp and weft strands or may be insulating adhesive to help electrically isolate overlapping warp and weft strands.

As shown in FIG. 4, unit 52 may include rollers 102. Rollers 102 may be controlled by motors that receive control signals from control circuitry 70. Rotation of rollers 102 may be used to move belt 108 and thereby control the lateral position of adhesive pads 106 relative to strand 28. Using pad 104 (e.g., a pad of a foam material or other compressible material), unit 52 can press adhesive 106 onto strand 28, as shown in FIG. 4. Pad 104 can be pressed downward towards strand 28 using positioner 54 and/or positioning equipment 74 may control heddles 80 so that strand 28 is drawn upwards against pad 104 and belt 108.

Figure 5:
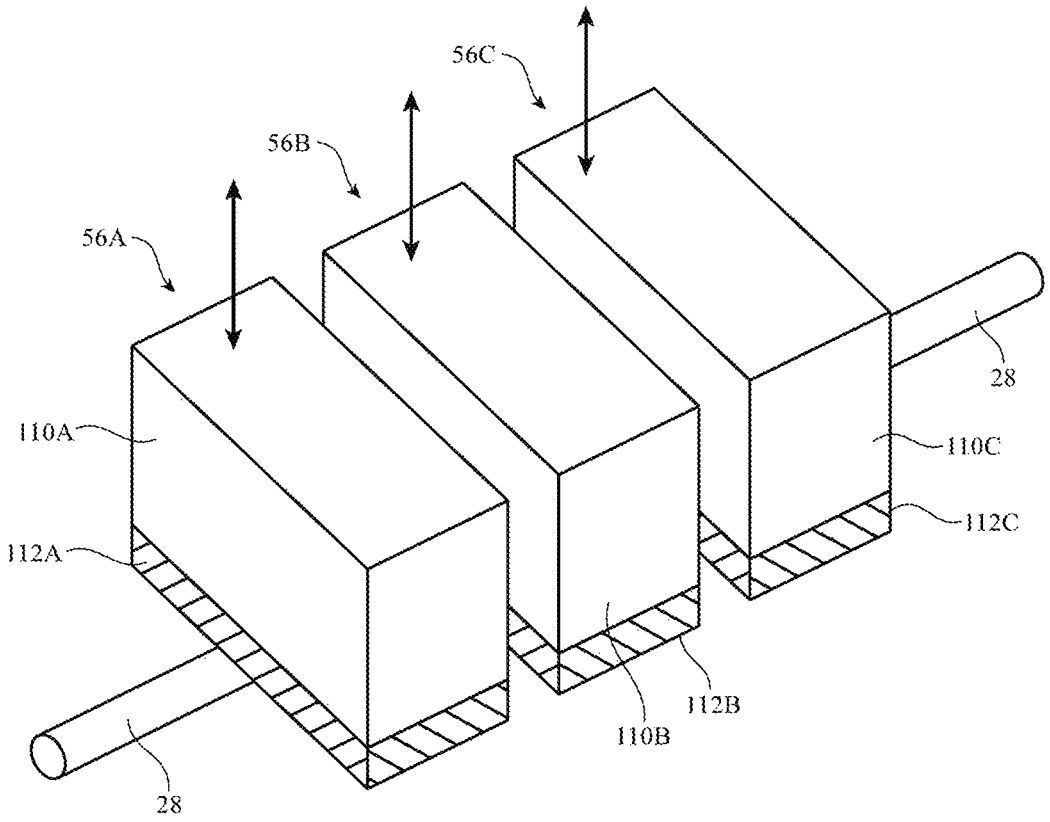
FIG. 5 is a perspective view of an illustrative tool for selectively applying various materials to a strand as the strand is being woven with other strands to form a fabric in accordance with an embodiment.

Illustrative coating equipment for use in unit 52 of system 22 is shown in FIG. 5. In the example of FIG. 5, unit 52 has three coating application heads 56A, 56B, and 56C having respective computer-controlled support structures 110A, 110B, and 110C that adjust the positions of corresponding liquid-filled foam pads 112A, 112B, and 112C. The positions of each head can be adjusted by a respective positioner such as positioner 54 of FIG. 2. Pads 112A, 112B, and 112C may be filled with liquids of different properties (e.g., different colors of ink, different adhesives, different metallic paints, solvents, combinations of these liquids and/or other liquids, etc.). When it is desired to coat strand 28 with the liquid in pad 112A, support structure 110A may be moved towards strand 28. When it is desired to coat strand 28 with the liquid in pad 112B, support structure 110B may be moved towards strand 28. Support structure 110C may be moved towards strand 28 when it is desired to coat strand 28 with the liquid in pad 112C.

Figure 6:
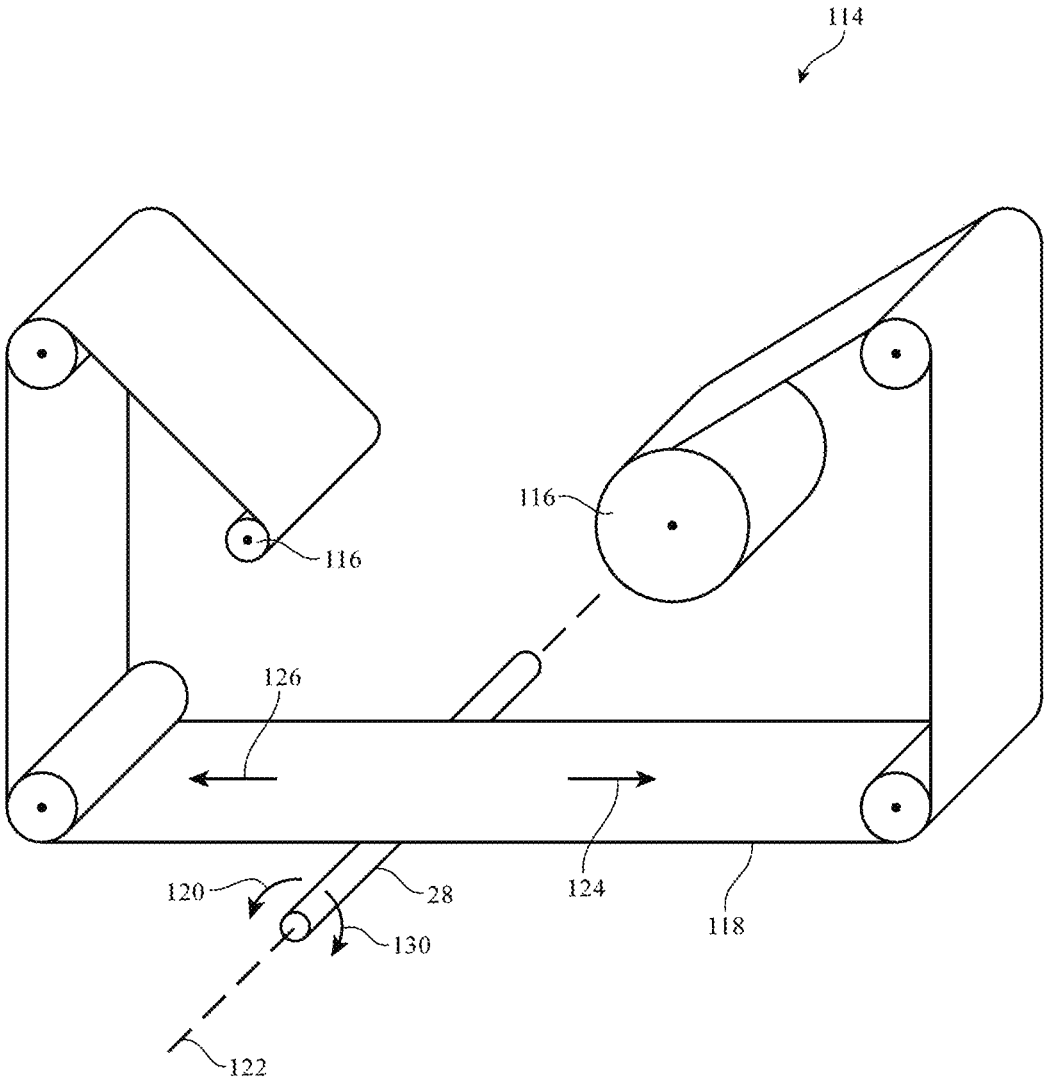
FIG. 6 is a perspective view of illustrative strand rotating equipment for rotating a strand to allow portions of the outer surface of the strand to be exposed to coating equipment or other equipment for processing the strand as the strand is being woven with other strands in accordance with an embodiment.

When using coating equipment of the type shown in FIG. 5, only one side of strand 28 may be coated absent rotation of strand 28 about its longitudinal axis. FIG. 6 is a perspective view of a belt-based strand rotation device that may be used in unit 52 to help coat additional portions of strand 28. As shown in FIG. 6, strand rotator 114 may have computer-controlled rollers 116 that are controlled by control signals from control circuitry 70. Rollers 116 may be rotated to move belt 118 in direction 124 or in direction 126. Strand 28 may extend along strand axis 122. Belt 118 may contact the outer surface of strand 28, so that movement of belt 118 in direction 126 or 124 rotates strand 28 respectively in direction 120 or 130 about axis 122.

Figure 7:
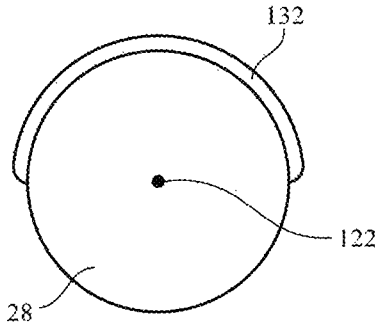
FIG. 7 is a cross-sectional axial view of an illustrative strand that has been treated along an upper portion of the strand in accordance with an embodiment.
Figure 8:
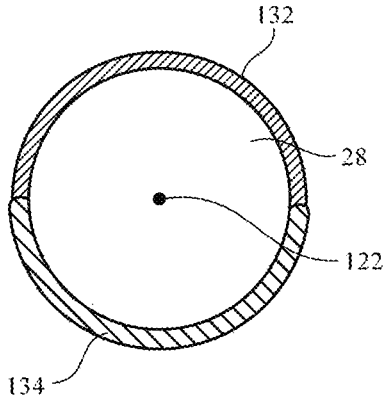
FIG. 8 is a cross-sectional axial view of an illustrative strand that has been treated along opposing upper and lower portions of the strand in accordance with an embodiment.
Figure 9:
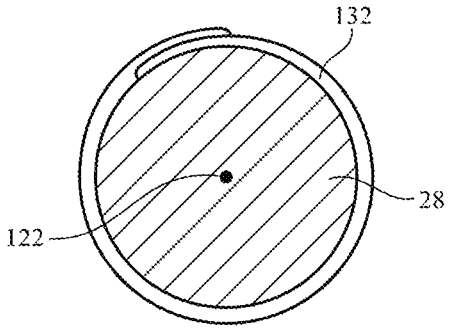
FIG. 9 is a cross-sectional axial view of an illustrative strand that has been treated around its circumference by rotating the strand in accordance with an embodiment.

By rotating strand 28 with rotator 114, head 56 or other coating equipment in system 22 can coat all surfaces (top and bottom) of strand 28. FIG. 7 is a cross-sectional view of strand 28 in a scenario in which the upper surface of strand 28 has been coated with coating 132 (e.g., dielectric, metallic paint, etc.). In the illustrative scenario of FIG. 8, the upper surface of strand 28 has been coated with coating 132 and, following rotation about axis 122 by strand rotation equipment 114 of FIG. 6 or other equipment, the lower surface of strand 28 has been coated with coating 134. FIG. 9 is a cross-sectional view of strand 28 in a scenario in which both the upper and lower surfaces of strand 28 have been coated with coating 132 by rotating strand 28 about axis 122 during the coating process (e.g., using rotator 144 of FIG. 6).

Figure 10:
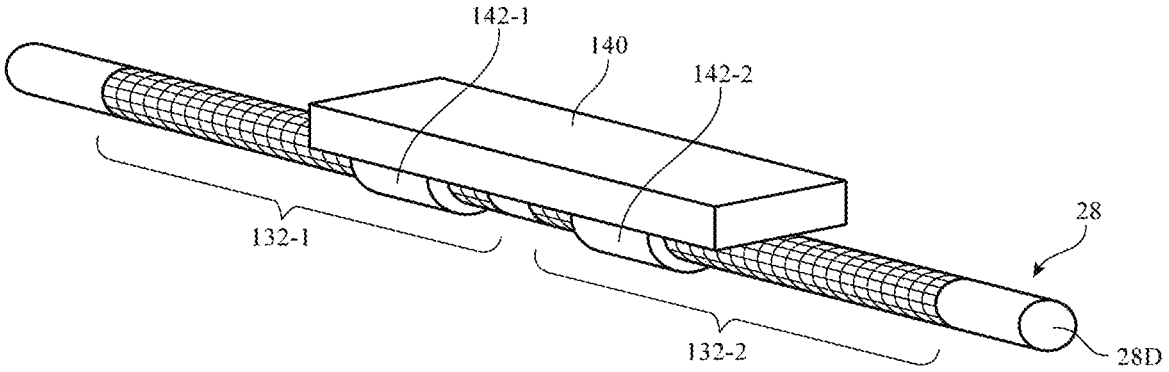
FIG. 10 is a perspective view of an illustrative electrical component that has been attached to a strand before the strand is woven with other strands to form a fabric in accordance with an embodiment.

FIG. 10 is a perspective view of an illustrative electrical component mounted to strand 28. As shown in FIG. 10, strand 28 may have a dielectric core 28D and electrically isolated segments with respective conductive coatings 132-1 and 132-2. Electrical component 140 (e.g., an integrated circuit, a light-emitting diode or other light source, a sensor, etc.) may have terminals 142-1 and 142-2. Terminals 142-1 and 142-2 may be formed from metal and may be crimped using unit 52. As shown in FIG. 10, for example, terminal 142-1 may be crimped to form a connection to metal coating segment 132-1 and terminal 142-2 may be crimped to form a connection to metal coating segment 132-2.

In the illustrative configuration of FIG. 10, component 140 has two terminals. In general, component 140 may have any suitable number of terminals (three, four, etc.). Crimped connections, solder connections, conductive adhesive connections, welds, or other electrical connections may be used by unit 52 to couple the terminals of component 140 to the metal coating portions of strand 28. If desired, strand 28 may have a metal core and an insulating coating. The configuration of FIG. 10 in which metal segments have been formed on the exterior surface of a dielectric strand core is merely illustrative.

Figure 11:
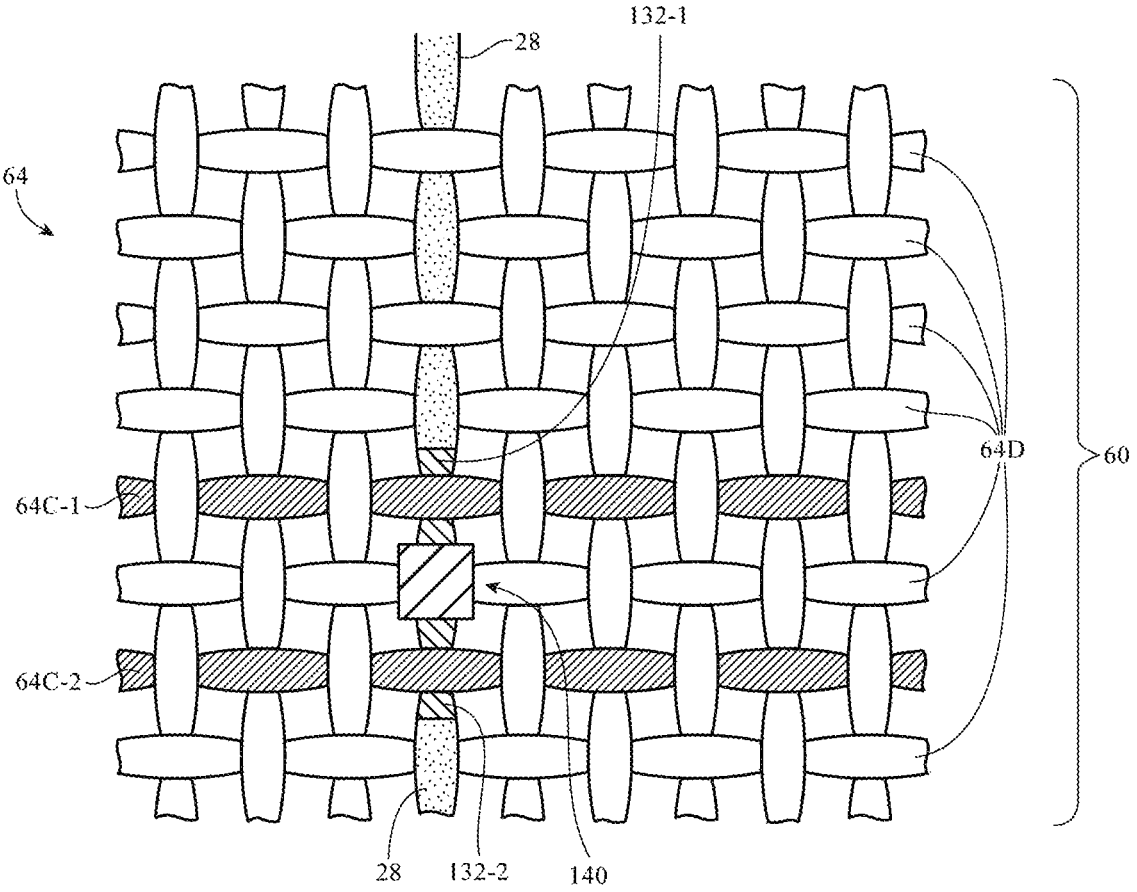
FIG. 11 is a top view of an illustrative woven fabric in which a strand with an electrical component of the type shown in FIG. 10 has been incorporated in accordance with an embodiment.

FIG. 11 is a top view of fabric 60 showing how warp strands 28 may be woven with weft strands 64. Just prior to being woven into fabric 60, unit 52 may modify strand 28 to add conductive segments 132-1 and 132-2 and to add electrical component 140. Weaving can then continue using system 22 until fabric 60 of FIG. 11 is formed. In the example of FIG. 11, some of weft strands 64 (i.e., strands 64D) are formed from dielectric or have a dielectric coating and therefore have insulating surfaces, whereas other weft strands 64 (i.e., strands 64C-1 and 64C-2) are formed from metal or dielectric with metal coating and are therefore have conductive surfaces. By modifying warp strands such as warp strand 28 of FIG. 11 just before the warp strand is woven with weft strands 64 to form fabric 60, it is possible to accurately align and mate warp strand features such as conductive segments (terminals) 132-1 and 132-2 with respective overlapping weft strand features such as conductive weft strands 64C-1 and 64C-2. This allows conductive weft strand 64C-1 to serve as a signal line to carry signals to conductive segment 132-1 on strand 28, which is coupled to terminal 142-1 of component 140. Conductive weft strand 64C-2 can serve as a signal line that carries signals to conductive segment 132-2 on strand 28, which is coupled to terminal 142-2 of component 140. Strands such as strands 64C-1 and 64C-2 may be interconnected with other conductive strands that form signal paths that couple component 140 into circuitry 16 for a fabric-based item such as strand-based item 10.

Figure 12:
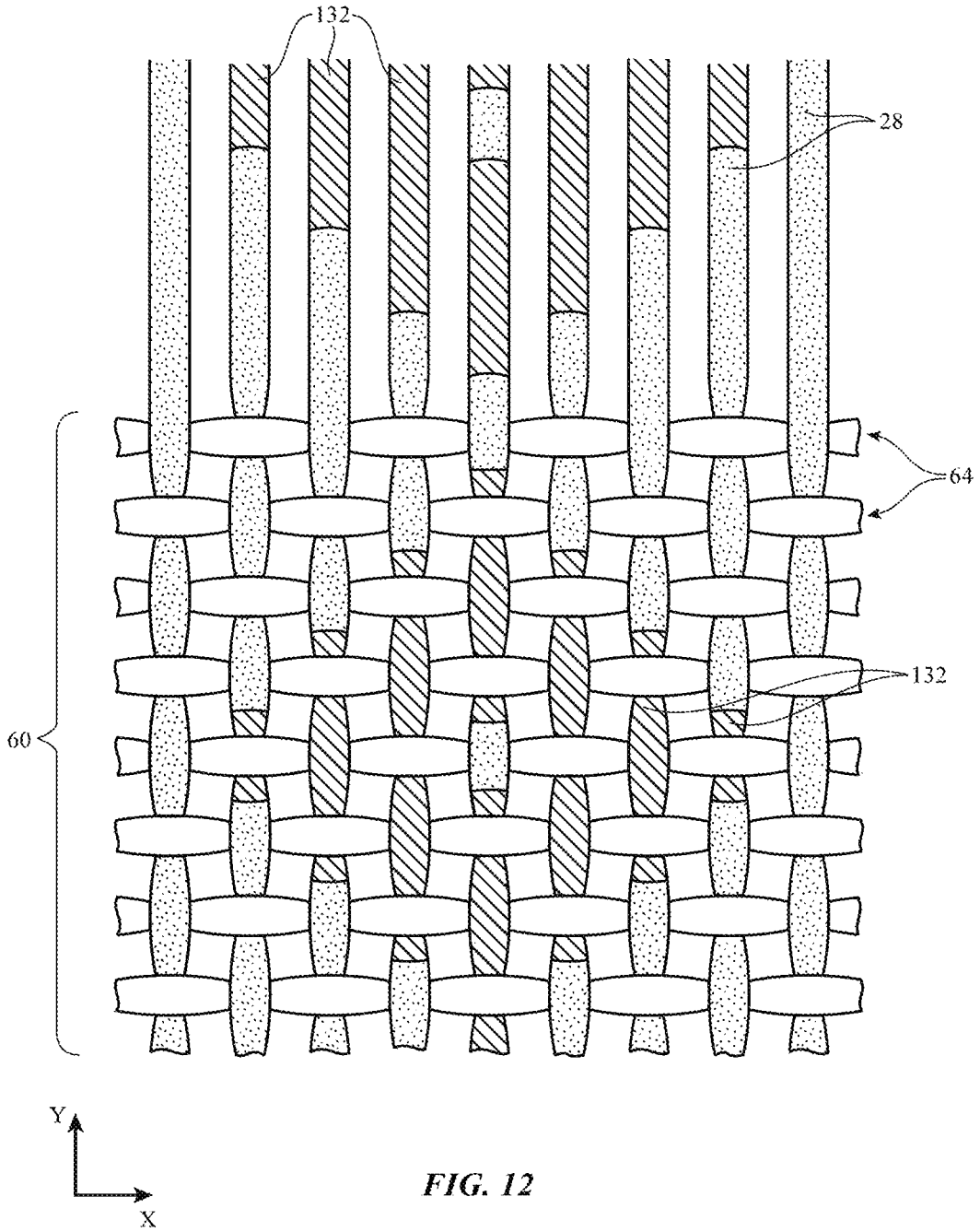
FIG. 12 is a top view of an illustrative woven fabric showing how selectively modified strands may be woven into a fabric to create a desired pattern of modified strand segments in accordance with an embodiment.

In the illustrative example of FIG. 12, strand segments 132 (e.g., conductive coating, insulating coating, portions of an insulated wire that have been stripped of insulation, etc.) may be formed on warp strands 28 with unit 52 just before warp strands 28 are incorporated into fabric 60 with weft strands 64. Because segments 132 (e.g., conductive coating, etc.) are patterned onto warp strands 28 just before fabric 60 is formed, segments 132 may be accurately aligned along dimension Y, so that each segment overlaps a desired one of weft strands 64 running along perpendicular dimension X.

Weft strands 64 of FIG. 12 may include one or more bare metal wires or metal-coated wires that are shorted to conductive metal segments 132 wherever the conductive metal segments overlap strands 64. The conductive segments 132 and weft strands 64 may be patterned to form a sensor (e.g., a capacitive touch sensor for a button), may be used to form interconnects (e.g., conductive paths for signals in circuitry 16 such as conductive paths that interconnect components such as component 140 to other circuitry), or may be used to form other suitable structures for item 10.

Figure 13:
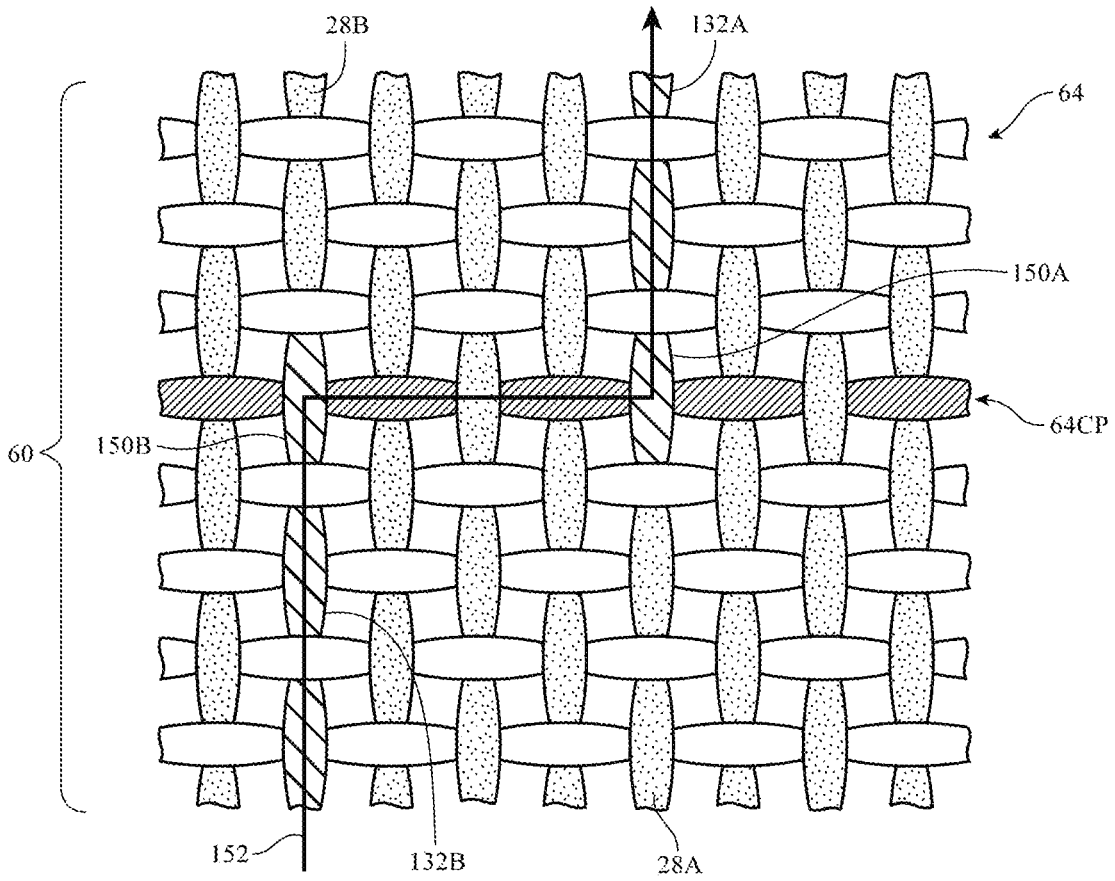
FIG. 13 is a top view of an illustrative woven fabric showing how selectively modified strands may be woven into a fabric to create a desired signal path in accordance with an embodiment.

In the illustrative example of FIG. 13, the ability to accurately align warp strand portions 132 with desired weft strands 64 has been used to form conductive signal path 152. As shown in FIG. 13, signal path 152 has been formed by overlapping end 150A of conductive segment 132A on warp strand 28A with weft strand 64CP and by overlapping end 150B of conductive segment 132B on warp strand 28B with weft strand 64CP. Weft strand 64CP may, as an example, be a conductive strand and segments 132A and 132B may be conductive segments from metal coatings and/or bared metal cores of insulated strands. Path 152 may be formed by coupling these conductive strand portions together as shown in FIG. 13.

To prevent undesired short circuit paths in the illustrative configuration of FIG. 13, the weft strands in fabric 60 other then conductive signal path weft strand 64CP and the warp strand portions other than segments 132A and 132B may be insulating. In general, any suitable pattern of interconnects may be formed using overlapping conductive warp strand and weft strand portions. For example, signals may be routed across one or more warp strands, across one or more weft strands, may traverse one or more warp-to-weft and one or more weft-to-warp connections, etc.

Electrical connections in fabric 60 may be made by ensuring that the overlapping strand portions in a signal path are formed from conductive material (e.g., metal, metal in metallic paint, etc.). The metallic paint, conductive adhesive, or other material that is applied to strands 28 to form segments 132 may be dried and/or cured before overlapping strands 28 and strands 64 or wet liquid metallic paint, uncured liquid conductive adhesive, or other moist applied material may be used in forming electrical connections (i.e., strand 28 may be coated with metallic paint and woven with weft strands 64 before the metallic paint has completely dried).

If desired, connections may be augmented using conductive materials such as conductive adhesive, solder, metallic paint, or other conductive materials applied to the bare metal or metal coating of segments 132 using equipment such as unit 52. Adding conductive material to the joints between overlapping strands in a signal path may help reduce resistance along the path. In some situations, additional conductive material can be omitted (e.g., when overlapping conductive strands form low-contact-resistance connections). This may help reduce fabrication complexity.

In some designs, it may be desirable for conductive strands to pass over each other without forming an electrical connection. Consider, as an example, a fabric in which warp strands 28 contain a mixture of insulating strands and conductive strands and in which weft strands 64 contain a mixture of insulating strands and conductive strands. The insulating strands may be, for example, polymer strands and the conductive strands may be, for example, bare metal strands or polymer strands coated with metal. In this type of arrangement, a given conductive warp strand may cross over a given conductive weft strand even though an electrical connection is not desired between these two strands. The conductive strands may overlap to form a desired pattern of signal interconnects, to form a capacitive touch sensor array (with each sensing point corresponding to an overlap between a warp and weft strand), or to form other structures for item 10.

Figure 14:
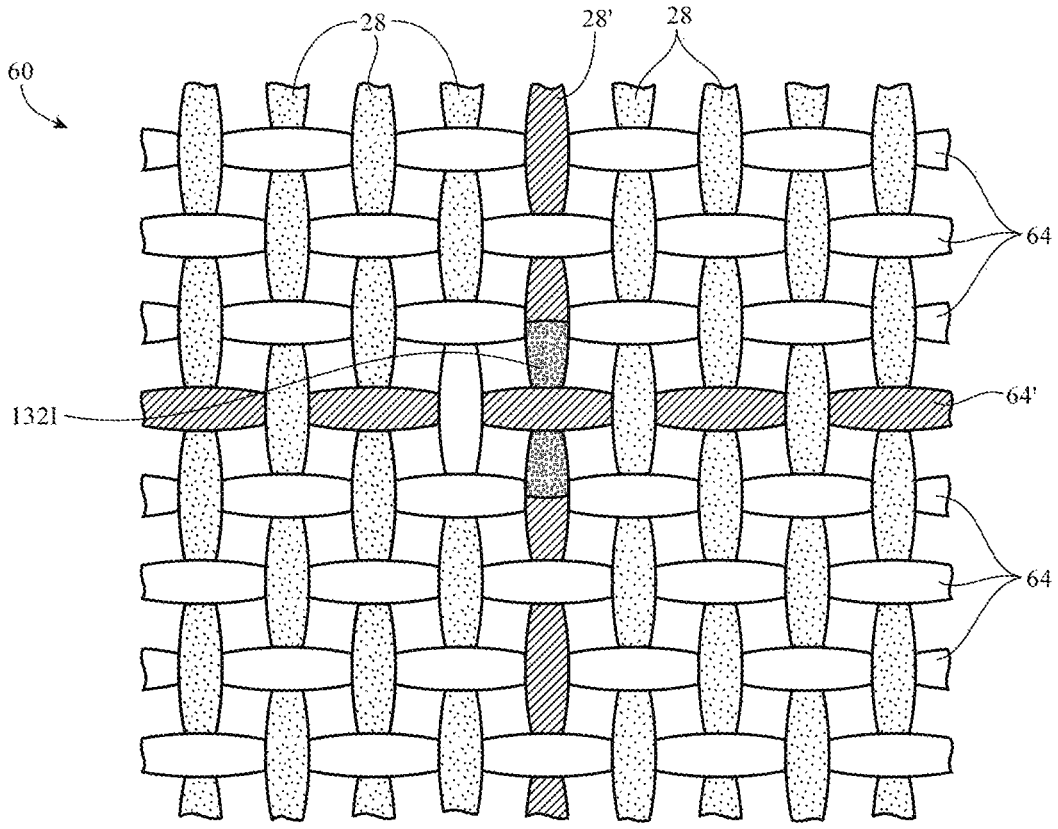
FIG. 14 is a top view of an illustrative woven fabric showing how a portion of a conductive strand with a selectively applied insulating coating may be aligned with an intersecting conductive strand in accordance with an embodiment.

As shown in FIG. 14, for example, conductive warp strand 28' may be surrounded by adjacent insulating warp strands 28 and conductive weft strand 64' may be surrounded by adjacent insulating weft strands 64. In the portion of fabric 60 that is shown in FIG. 14, it is not desired to form an electrical connection between conductive warp strand 28' and conductive weft strand 64' even though these two strands overlap. Accordingly, insulating layer 132I has been added to warp strand 28' using unit 52 (e.g., equipment of the type shown in FIG. 4, equipment of the type shown in FIG. 3 such as coating tool 92, etc.). Insulating layer 132I may be a polymer coating, a layer of adhesive such as adhesive 106 of FIG. 4, or other dielectric coating. Insulating layer 132I may be placed on the upper surface of strand 28' (see, e.g., FIG. 7) or may cover both the top and bottom of strand 28' (see, e.g., FIGS. 8 and 9 in which strand 28' is surrounded with coating material).

Figure 15:
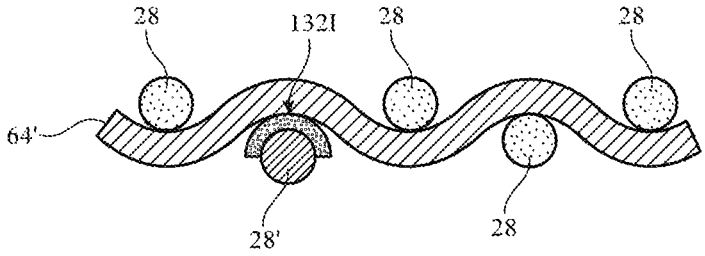
FIG. 15 is a cross-sectional side view of an illustrative portion of the fabric of FIG. 14 in which a selectively applied insulating coating has been interposed between overlapping conductive strands in accordance with an embodiment.

As shown in the cross-sectional side view of FIG. 15, strands 28' and 64' may be electrically isolated from each other using interposed insulating coating such as insulating layer 132I.

When a dielectric material such as layer 132I is interposed between respective conductive strands in fabric 60, the conductive strands will not be electrically shorted to each other at direct current (DC) frequencies. This allows signals to be routed through the conductive strands without inadvertent shorts (i.e., the conductive strands may form a desired signal interconnect pattern in fabric 60). If desired, the intersections at which conductive warp and weft strands overlap may serve as capacitive touch sensor electrodes (e.g., touch sensor locations in a mutual capacitance touch sensor array). In a capacitive touch sensor arrangement, alternating current (AC) drive signals may be applied to weft strands and sense signals may be gathered at warp strands that are separated from the weft strands by insulating portions 132I or drive signals may be applied to the warp strands while sense signals are gathered at weft strands. Other types of capacitive touch sensor may be formed in which warp and weft strands are separated by insulating portions 132I, if desired. The use of overlapping sense and drive signal paths formed from perpendicular conductive strands in fabric 60 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. A fabric having a conductive strand, comprising:

warp strands including at least one warp strand that has first and second conductive segments and an insulating segment interposed between the first and second conductive segments, wherein the first and second conductive segments and the insulating segment share a common longitudinal axis and are located along a length of the at least one warp strand;

an electrical component having a first terminal coupled to the first conductive segment and a second terminal coupled to the second conductive segment; and weft strands woven with the warp strands, wherein the weft strands include a first conductive weft strand that conveys electrical signals from the conductive strand in the fabric to the first conductive segment.

2. The fabric defined in claim 1 wherein the first conductive weft strand overlaps the first conductive segment and is electrically connected to the first conductive segment, and wherein the weft strands further include:

a second conductive weft strand that overlaps the second conductive segment and that is electrically connected to the second conductive segment.

3. The fabric defined in claim 2 wherein the electrical component comprises a light-emitting diode.

4. The fabric defined in claim 2 wherein the first terminal comprises a first metal terminal that is crimped onto the first conductive segment and wherein the second terminal comprises a second metal terminal that is crimped onto the second conductive segment.

5. The fabric defined in claim 1 wherein the electrical component comprises a sensor.

6. The fabric defined in claim 1 wherein the warp strand has first and second additional insulating segments and wherein the first and second conductive segments are interposed between the first and second additional insulating segments.

7. The fabric defined in claim 1 wherein the at least one warp strand comprises a dielectric core and a conductive coating.

8. The fabric defined in claim 1 wherein the at least one warp strand comprises a conductive core and a dielectric coating.

9. The fabric defined in claim 1 wherein the first terminal comprises a first metal terminal that is soldered to the first conductive segment and wherein the second terminal comprises a second metal terminal that is soldered to the second conductive segment.

10. A fabric, comprising:

warp strands including at least first, second, and third warp strands, wherein the first warp strand has a first conductive segment, wherein the second warp strand has a second conductive segment, and wherein the third warp strand has a pair of conductive segments that share a common longitudinal axis and are located along a length of the third warp strand;

an electrical component having first and second terminals respectively coupled to the pair of conductive segments on the third warp strand; and weft strands woven with the first, second, and third warp strands, wherein the weft strands include at least one weft strand with a third conductive segment, wherein the third conductive segment conveys electrical signals between the first conductive segment and the second conductive segment.

11. The fabric defined in claim 10 wherein the third conductive segment is soldered to the first conductive segment and the second conductive segment.

12. The fabric defined in claim 10 wherein the first warp strand has a first insulating segment and the second warp strand has a second insulating segment.

13. The fabric defined in claim 10 wherein the weft strands include insulating weft strands.

14. The fabric defined in claim 10 wherein the warp strands include an insulating warp strand interposed between the first and second warp strands.

15. A fabric having a conductive strand, comprising:

warp strands including a first warp strand having a first conductive segment and a second warp strand having a pair of conductive segments that share a common longitudinal axis and are located along a length of the second warp strand;

an electrical component having first and second terminals respectively coupled to the pair of conductive segments on the second warp strand;

weft strands woven with the first and second warp strands, wherein the weft strands include a first weft strand having a second conductive segment and a second weft strand that conveys electrical signals from the conductive strand to one of the conductive segments in the pair of conductive segments; and an insulating structure interposed between the first and second conductive segments that electrically insulates the first conductive segment from the second conductive segment.

16. The fabric defined in claim 15 wherein the insulating structure comprises a layer of adhesive.

17. The fabric defined in claim 15 wherein the first warp strand has a circumference and wherein the insulating structure extends only partially around the circumference.

18. The fabric defined in claim 15 wherein the first conductive segment forms a drive line and the second conductive segment forms a sense line in a touch sensor.

19. The fabric defined in claim 15 wherein the second conductive segment forms a drive line and the first conductive segment forms a sense line in a touch sensor.

* * * * *